US005414605A

United States Patent [19]

Lin

[11] Patent Number: 5,414,605

[45] Date of Patent: May 9, 1995

[54] LAMP ASSEMBLY

[76] Inventor: Cheng-Yuan Lin, No. 39, Sec. 3, Chung-Hua Rd., Hsinchu City, Taiwan, Prov. of China

[21] Appl. No.: 97,041

[22] Filed: Jul. 27, 1993

[51] Int. Cl.[6] ..... F21V 31/00

[52] U.S. Cl. ..... 362/267; 362/806

[58] Field of Search ..... 362/267, 158, 363, 806

[56] References Cited

U.S. PATENT DOCUMENTS

| | | | |
|---|---|---|---|
| 2,347,055 | 4/1944 | Johnson | 362/267 |
| 2,481,054 | 9/1949 | Wendel | 362/267 |
| 2,709,217 | 5/1955 | McCluskey | 362/267 |
| 3,248,531 | 4/1966 | Dover | 362/267 |
| 3,763,367 | 10/1973 | Nitsch et al. | 362/267 |
| 4,450,511 | 5/1984 | Micha | 362/267 |
| 4,521,836 | 6/1985 | Puttemanns et al. | 362/267 |

*Primary Examiner*—Richard R. Cole

*Attorney, Agent, or Firm*—Jacobson, Price, Holman & Stern

[57] ABSTRACT

A lamp assembly includes a lamp holder, a lamp that is mounted on the lamp holder, and a lampshade unit that covers the lamp. The lamp holder includes a vertical cylindrical housing which is made of an insulating material and which has an open top and a bottom wall, and a lamp seat that is mounted securely in the housing so as to define an annular groove between the lamp seat and the housing. The housing has a bottom hole formed in the bottom wall thereof. The lamp is connected securely to an upper end portion of the lamp seat and has two electrical wires that extend through the lamp seat and the bottom hole of the housing. The lampshade unit includes a generally cylindrical rubber seal which is retained within the annular groove of the housing, and a transparent lampshade which covers the lamp and which has an annular bottom end portion that is sleeved on the lamp seat and that is retained within the rubber seal. Accordingly, a tight connection is provided between the lampshade unit and the lamp holder so as to protect the lamp from rain.

2 Claims, 2 Drawing Sheets

LAMP ASSEMBLY

BACKGROUND OF THE INVENTION

1. Field of the Invention

This invention relates to a decorative lamp assembly, more particularly to a decorative lamp assembly which can be protected from rain.

2. Description of the Related Art

A conventional lamp 1 is shown in FIG. 1 to include a transparent lampshade 11, an externally threaded conductive end portion 12 disposed at a lower end section of the lampshade 11, and a filament 13 mounted within the transparent lampshade 11. The externally threaded conductive end portion 12 is connected to a lamp seat (not shown) of the lamp 1.

The drawbacks of the conventional lamp 1 are as follows:

1. When used outdoors, the conventional lamp 1 easily short-circuits due to a leakage of water, which water may result from rain.

2. When a user breaks the transparent lampshade 11 by accident, the lamp 1 may explode. As a result, the conventional lamp 1 is very dangerous to use.

3. When used for decorating, the conventional lamp 1 consumes much electricity due to the fact that the conventional lamp 1 needs seven watts of electric power.

SUMMARY OF THE INVENTION

The main object of this invention is to provide a decorative lamp assembly which can be protected from rain.

According to this invention, a lamp assembly includes a lamp holder, a lamp that is mounted on the lamp holder, and a lampshade unit that covers the lamp.

The lamp holder includes a vertical cylindrical housing which is made of an insulating material and which has an open top and a bottom wall, and a lamp seat that is mounted securely in the housing and that has a wire passage formed therethrough so as to define an annular groove between the lamp seat and the housing. The housing has a bottom hole formed through the bottom wall thereof. The wire passage of the lamp seat is communicated with the bottom hole of the housing.

The lamp is connected securely to an upper end portion of the lamp seat and has two electrical wires that extend through the wire passage of the lamp seat and the bottom hole of the housing. The lamp holder further includes a waterproof cap mounted removably on a bottom end of the housing so as to cover the bottom hole of the housing of the lamp holder. The waterproof cap has two holes so as to allow the electrical wires to extend therethrough.

The lampshade unit includes a generally cylindrical rubber seal which is retained within the annular groove of the housing, and a transparent lampshade which covers the lamp and which has an annular bottom end portion that is sleeved on the lamp seat and that is retained within the rubber seal.

The lamp holder includes several elongated axial ribs that project inwardly from an inner side wall of the housing to press the rubber seal against the annular bottom end portion of the transparent lampshade. Accordingly, a tight connection is provided between the rubber seal and the annular bottom end portion of the transparent lampshade so as to protect the lamp from rain.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
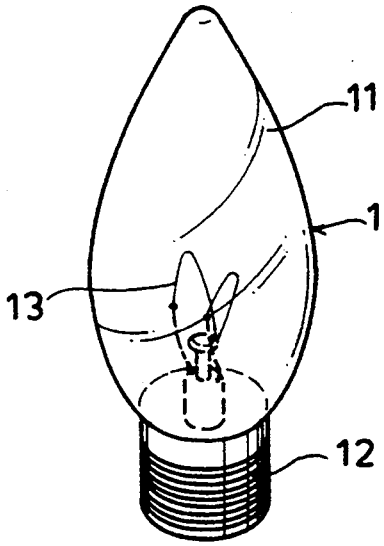
PRIOR ART FIG.1
FIG. 1 is a perspective view of a conventional lamp.
Figure 3:
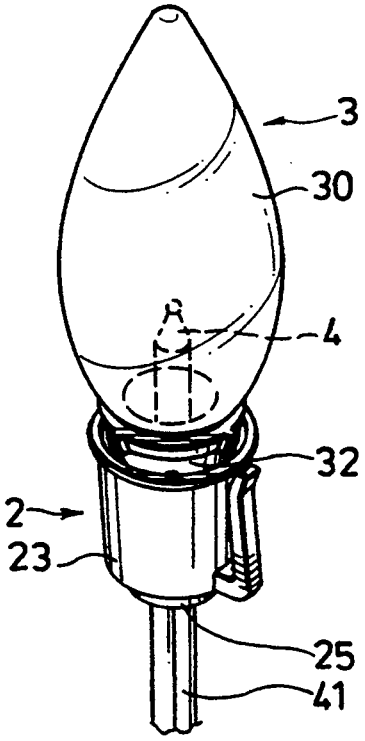
FIG. 3 is an assembled view of the lamp assembly of this invention.
Figure 2:
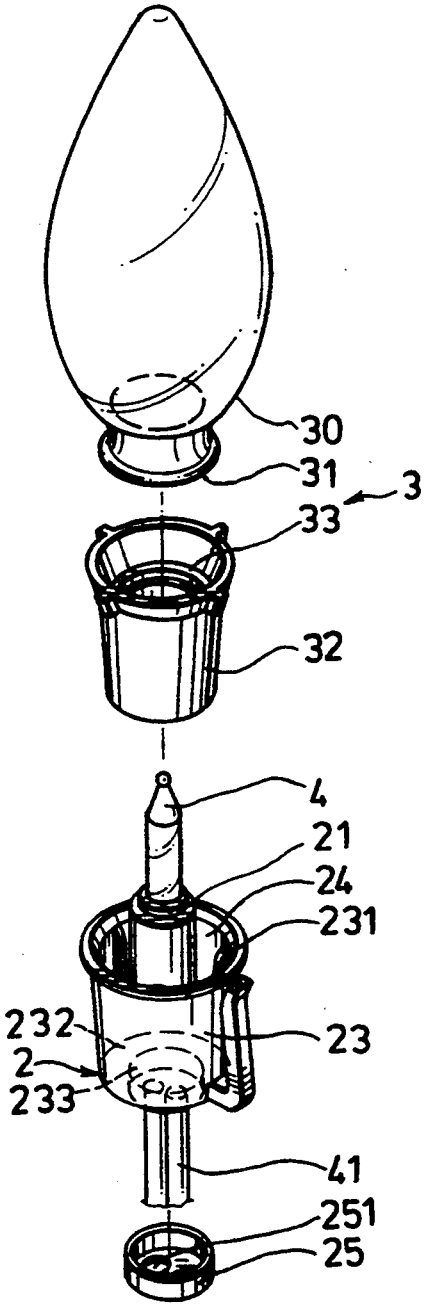
FIG. 2 is an exploded view of a lamp assembly in accordance with this invention.

Referring to FIGS. 2 and 3, a lamp assembly of this invention includes a lamp holder 2, a lamp 4 that is mounted in the lamp holder 2, and a lampshade unit 3 that covers the lamp 4.

The lamp holder 2 has a vertical cylindrical housing 23 and a lamp seat 21. The cylindrical housing 23 is made of an insulating material and has an open top and a bottom wall 232. The lamp seat 21 is mounted securely on the bottom wall 232 of the cylindrical housing 23 and has a wire passage (not shown) formed therethrough so as to define an annular groove 24 between the lamp seat 21 and the cylindrical housing 23. The bottom wall 232 of the cylindrical housing 23 has a bottom hole 233 formed therein and communicated with the wire passage of the lamp seat 21.

The lamp 4 is connected securely to an upper end portion of the lamp seat 21 and has two electrical wires 41 that extend through the wire passage of the lamp seat 21 and the bottom hole 233 of the cylindrical housing 23. The lamp holder 2 further includes a waterproof cap 25 removably mounted on a bottom end of the cylindrical housing 23 so as to cover the bottom hole 233 of the cylindrical housing 23. The waterproof cap 25 has two holes 251 so as to allow the electrical wires 41 of the lamp 4 to extend therethrough.

The lampshade unit 3 includes a generally cylindrical rubber seal 32 and a transparent lampshade 30. The transparent lampshade 30 covers the lamp 4 and has an annular bottom end portion or outward flange 31 that is sleeved on the lamp seat 21 under the inward flange 33 of the cylindrical rubber seal 32. The outward flange 31 of the lampshade 30 has an outer diameter which is slightly greater than the inner diameter of the inward flange 33 of the rubber seal 32 so that the outward flange 31 can be pushed or pulled forcibly to extend through the inward flange 33 of the rubber seal 32.

The lamp holder 2 further includes several elongated axial ribs 231 that project inwardly from an inner side wall of the cylindrical housing 23 to press the cylindrical rubber seal 32 against the outward flange 31 of the transparent lampshade 30 so as to retain the rubber seal 32 within the annular groove 24 of the housing 23. Accordingly, a tight connection is provided between the cylindrical rubber seal 32 and the outward flange 31 of the transparent lampshade 30 so as to protect the lamp 4 from rain.

The advantages of the preferred embodiment of the lamp assembly according to this invention are as follows:

1. Because the lamp holder 2 and the lampshade unit 3 have a tight connection, the lamp 4 cannot short-circuit due to a leakage of rain water, which the lamp assembly is used outdoors.

2. The lamp 4 may be a 0.2 A*2.5 V, 0.2 A*3.5 V, 0.14 A*7 V, or a 0.95 A*12 V lamp type. The former three are suitable for decorative purpose since they consume relatively low electrical power. The 12 V lamp type is ideal if a sufficiently bright lamp is required.

3. Because the transparent lampshade 30 is used to cover the lamp 4, the lamp 4 does not explode, when the transparent lampshade 30 is broken by accident, the lamp 4 cannot explode.

4. The transparent lampshade 30 of the lamp assembly can be of various shapes, thereby enhancing the aesthetic appeal of the lamp assembly of this invention.

With this invention thus explained, it is apparent that numerous modifications and variations can be made without departing from the scope and spirit of this invention. It is therefore intended that this invention be limited only as indicated in the appended claims.

I claim:

1. A lamp assembly comprising:

a lamp holder including a vertical cylindrical housing which is made of an insulating material and which has an open top, an inner side wall and a bottom wall, and a lamp seat that is mounted securely in said housing so as to define an annular groove between said lamp seat and said housing, said housing having a bottom hole formed in said bottom wall thereof;

a lamp being connected securely to an upper end portion of said lamp seat and having an electrical conduit extending through said lamp seat and said bottom hole of said housing;

a lampshade unit including a generally cylindrical rubber seal retained within said annular groove of said housing, and a transparent lampshade which covers said lamp and which has an annular bottom end portion that is sleeved on said lamp seat and that is retained within said rubber seal; and said lamp holder having several elongated axial ribs projecting inwardly from the inner side wall of said housing to press said rubber seal against said annular bottom end portion of said transparent lampshade; whereby, a tight connection is provided between said lampshade unit and said lamp holder.

2. A lamp assembly as claimed in claim 1, wherein said lamp holder further includes a waterproof cap mounted removably on a bottom end of said housing so as to cover said bottom hole of said housing of said lamp holder, said waterproof cap having means to allow said electrical conduit to extend therethrough.

* * * * *